US005158635A

United States Patent [19]

Schmierer et al.

[11] Patent Number: 5,158,635

[45] Date of Patent: Oct. 27, 1992

[54] METHOD FOR THE MANUFACTURE OF A CONNECTION MEMBER FOR FILTER BAGS

[75] Inventors: Erich Schmierer, Fürth/Bayern; Wilhelm Rösch, Siegelsdorf, both of Fed. Rep. of Germany

[73] Assignee: Branofilter GmbH, Dietenhofen, Fed. Rep. of Germany

[21] Appl. No.: 639,521

[22] Filed: Jan. 10, 1991

[30] Foreign Application Priority Data

Feb. 1, 1990 [DE] Fed. Rep. of Germany ..... 4002868

[51] Int. Cl.[5] ..... B01D 46/04; B32B 31/04

[52] U.S. Cl. ..... 156/367; 55/367; 156/227; 156/252; 220/253; 229/125.12; 229/125.33

[58] Field of Search ..... 55/367, 373; 220/253, 220/252, 345, 256; 229/125.12, 125.33, 125.02; 156/217, 227, 252

[56] References Cited

U.S. PATENT DOCUMENTS

| | | | |
|---|---|---|---|
| 1,007,390 | 10/1911 | Robinson | 229/125.12 X |
| 2,864,462 | 12/1958 | Brace | 55/367 |
| 3,483,679 | 12/1969 | Balbierer | 55/367 |
| 4,779,793 | 10/1988 | Runo et al. | 229/125.12 |
| 4,861,357 | 8/1989 | Gavin et al. | 55/367 |

FOREIGN PATENT DOCUMENTS

| | | | |
|---|---|---|---|
| 1301025 | 8/1969 | Fed. Rep. of Germany . | |
| 1628582 | 11/1971 | Fed. Rep. of Germany . | |
| 1628583 | 12/1971 | Fed. Rep. of Germany . | |
| 2320441 | 11/1973 | Fed. Rep. of Germany . | |
| 2407478 | 8/1974 | Fed. Rep. of Germany . | |
| 3833799 | 12/1990 | Fed. Rep. of Germany . | |
| 356800 | 9/1931 | United Kingdom | 229/125.12 |

*Primary Examiner*—Michael W. Ball
*Assistant Examiner*—Michele K. Yoder
*Attorney, Agent, or Firm*—Flynn, Thiel, Boutell & Tanis

[57] ABSTRACT

A connecting member for filter bags or the like used for collecting dust has a main body secured to the filter bag, which main body has a multi-ply structure of board or cardboard. The main body has a passageway therethrough for facilitating the passage of dust into the filter bag. A slide gate is arranged on the main body between two plies of the main body and a handle thereon projects laterally beyond the main body and is movable between a moved in position leaving the passage opening uncovered and a moved out position shutting it. The main body is folded from a single piece of material cutout along preset fold lines. The plies of the main body placed on top of each other after folding are bonded together. The slide gate is at least partly a component of the cutout and is connected with the rest of the cutout via preset tear lines so that the slide gate may be torn off to the side after folding and bonding.

9 Claims, 5 Drawing Sheets

Fig. 14
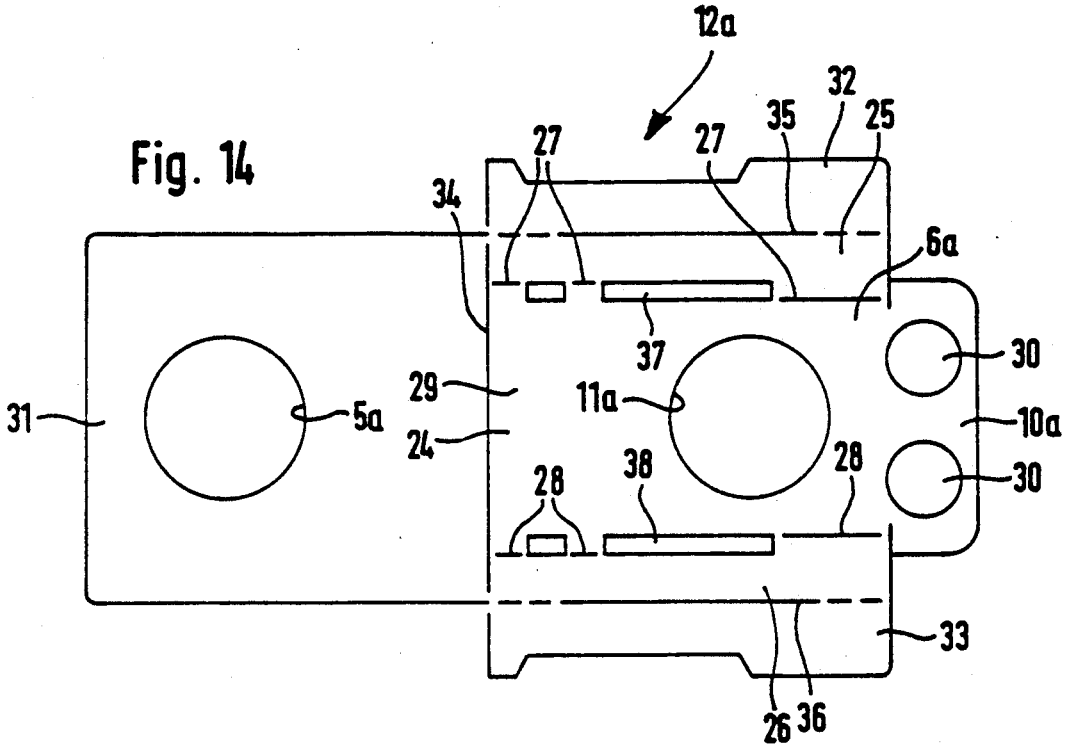
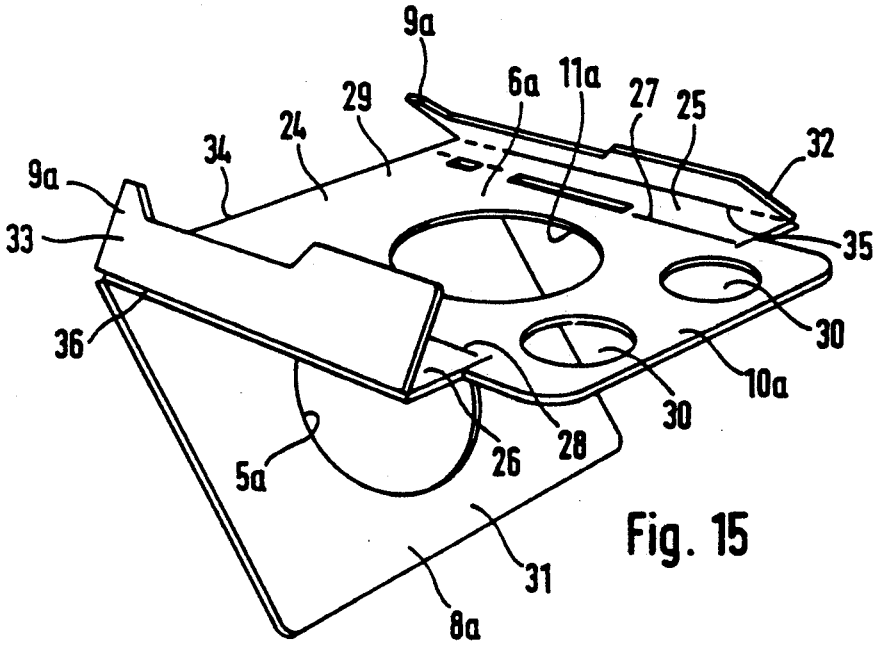
Fig. 15

METHOD FOR THE MANUFACTURE OF A CONNECTION MEMBER FOR FILTER BAGS

FIELD OF THE INVENTION

The invention relates to a method for the manufacture of connecting members for filter bags for vacuum cleaning equipment and for taking up dust, such connecting member having a main body, which is to be secured to the filter bag, has a passage opening corresponding to the dust inlet opening into the filter bag, has a multi-ply structure and a sheet-like configuration made of board-like material, and a gate slide positioned on the main body between two plies of the main body and with a handle projecting laterally past the main body, such slide being able to be moved between an open position leaving the passage opening open and a shut position closing the passage opening.

BACKGROUND OF THE INVENTION

Filter bags or the like are necessary for dust collection both in the case of large, commercial vacuum cleaners and also in the case of household vacuum cleaners. In this respect, a suction current is produced by means of a suction fan in order to draw the dust into a vacuum duct, vacuum hose or the like, whence the dust is conveyed through the dust inlet opening into the respective filter bag. The dust contained in the aspirated air is caught in the wall of the filter bag, whereas the air current freed of dust passes through the filter bag wall and is then blown off into the atmosphere. When the filter bag is full, it is removed and may be discarded.

Attachment of the filter bag to the vacuum cleaner equipment is by means of a connecting member positioned at the inlet opening thereof and more particularly secured thereto by bonding. This connecting member is, as noted above, particularly suitable for the provision of a slide gate. With the aid of the slide gate, it is possible for the inlet opening of the filter bag or, respectively, the passage opening of the connecting member to be closed, when the filter bag is discarded in order to ensure that no dust is able to escape from the filter bag into the atmosphere.

The U.S. Pat. No. 2,864,462 and the non-prior published German patent publication 3,833,799 A describe connecting members which are similar and are of the type initially mentioned. Such connecting members have a three-ply structure, the slide gate being contained in the center ply between two mutually opposite guide parts for the slide gate. For the production of such a connecting member, the two outer plies or layers, the two guide parts and the slide gate are cut from board or stiff paper material and then they are placed on top of each other and with the exception of the slide gate, they are bonded together.

The German patent publication 2,407,478 A also describes a connecting member of the type initially mentioned, in which the connecting member is formed with two plies with a flexible tape for the slide gate and positioned between the plies. In this case as well, the two plies are cut out and bonded together, the tape of the slide gate being placed between them and having its one end part, which runs in a fold, bonded in place.

This operation of cutting out the individual components of the connecting member and the following placement thereof on top of each other is time consuming and tedious. The individual components may, it is true, be stamped out quite rationally from strips of board or stiff paper, but they then have to be removed therefrom and separatly have adhesive brushed on them and then placed on top of each other with an exact alignment.

SHORT SUMMARY OF THE PRESENT INVENTION

Accordingly one object of the present invention is to provide a method for the production of such a connecting member, by which the connecting member may be produced in a particularly simple, low-cost manner.

In order to achieve these or other aims in the invention, the main body made in the form of an integral cutout, folded along preset fold lines and which, after folding of the superposed plies of the main body, are bonded together and, furthermore, the slide gate is at least partly a component of the cutout and in this respect is connected with the rest of the cutout by preset break lines so that the slide gate may be torn off to the side after folding and bonding.

Owing to the production of the main body on the basis of a single foldable cutout, which furthermore at least partly forms the gate slide, the complexity of manufacture is substantially reduced. In this respect the process of manufacture may be so performed that the cutouts stamped from board or stiff paper remain in the strip running through the manufacturing equipment and are folded and bonded in this position by means of suitable devices. All these manufacturing steps may be completely automated. The strip-like board material then serves as the means conveying the cutouts and the intermediate products and connection parts resulting therefrom. Furthermore, the different components will automatically be in the desired position on top of each other exactly after the folding operation.

The slide gate is then simultaneously positioned correctly as well, since in the finished connecting member it is firmly connected with the main body by means of the break or tear lines. The connecting member may be secured to the still-fixed slide gate on the filter bag. The slide gate then only has to be torn off when it is desired to remove the filter bag.

The slide gate connected with the main body by means of the preset tear lines furthermore leads to the advantage in the case of slide gates containing a flexible slide gate tape that the slide gate is not able to be accidentally pulled into its shut position before use of the filter bag, and from which it could hardly be pushed back into its open position owing to its flexible tape construction.

Although the German patent publication 1,301,025 A describes a connecting member which is produced from a foldable cutout and which forms a closure, which is associated with the passage opening and is held fast at preset tear points, the design relates not to a slide gate but rather to a pivoting door, which on insertion of the filter bag in the vacuum cleaner is pushed open since the preset tear points are torn open at a right angle to the plane of the connecting member. This is the same as the conventional pushing out of an individual part from a ply of material, as for instance when pushing and tearing open doors or windows in sheets of cardboard for making children's toys or as a familiar pastime.

In the case of parts moving like slides, such attachment using preset tear points is unusual. Furthermore, the slide gate present in the method in accordance with the invention is not torn open to make a passage opening but for later closing of the passage opening when the filter bag is later removed from the vacuum cleaner.

Further features and advantages of the invention will be gathered from the ensuing detailed description of embodiments thereof referring to the drawings.

LIST OF THE SEVERAL VIEWS OF THE DRAWINGS

FIG. 14 shows the cutout used for the production of the connecting member in accordance with FIGS. 11 through 13.

FIG. 15 is an oblique view of the cutout in accordance with FIG. 14 during the operation of triple folding of the structure.

DETAILED DESCRIPTION OF WORKING EMBODIMENTS OF THE INVENTION

Figure 1:
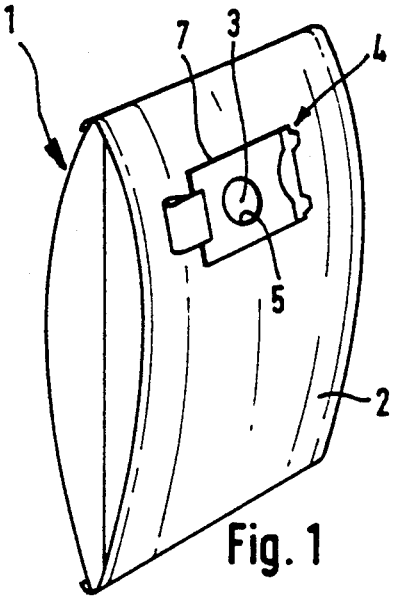
FIG. 1 is diagrammatic side elevation of a filter bag provided with a connecting member.
Figure 2:
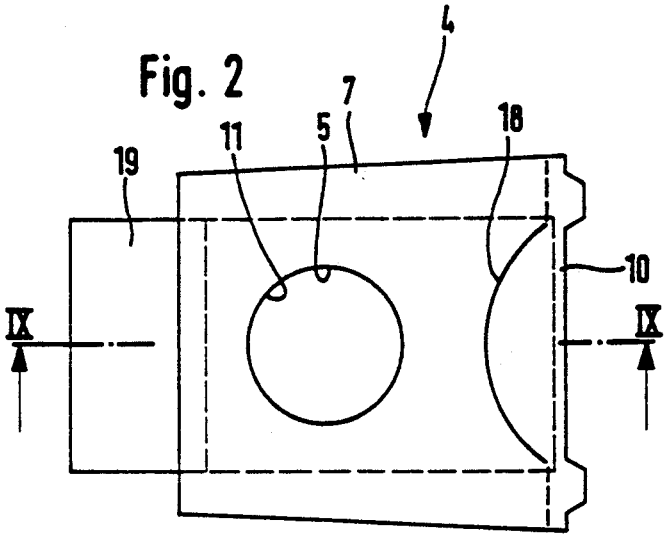
FIG. 2 is a front view of the connecting member in accordance with FIG. 1 shown separately.
Figure 3:
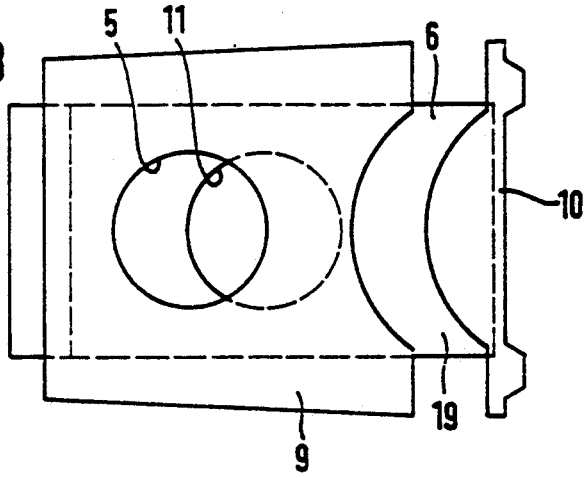
FIG. 3 shows the connecting member in accordance with FIG. 2 after the handle part of the slide gate has been torn off the main body and the slide gate has been moved somewhat towards its shut position.

The filter bag 1 more particularly illustrated in FIG. 1 and which might also be termed a filter sack or the like, is provided with an inlet opening 3 in its wall 2. A connecting member 4 is externally secured to the bag wall part adjacent the inlet opening 3, such connecting member generally being bonded to the bag wall 2. The vacuum cleaner device, for which the filter bag 1 is intended, has a suitable holding device for the connecting member 4 so that the filter bag is held in place by means of the connecting member 4 on the vacuum cleaner equipment. The connecting member 4 has a passage opening 5 corresponding to the dust inlet opening 3 of the bag wall so that when the connecting member is secured to the filter bag there is a passage defined by the passage opening 5 of the connecting member and the inlet opening 3 behind it, such passage making the interior of the bag accessible.

During use it is possible for the connecting member 4 of the filter bag to be set so that its passage opening 5 is moved somewhat on the connection spout or short nozzle of the vacuum cleaner. The dust laden air current, which is supplied by means of a fan or blower and passes via a suction duct, which is connected with the connection spout on the device or another connection means, or a suction hose, inflates the filter bag 1 and passes through the air-permeable material of the bag wall, the dust being retained in the interior of the bag.

When the filter bag is full, it is removed from the vacuum cleaner equipment and may be discarded. This removal of the full filter bag is difficult since it is possible for dust to escape through the passage formed by the openings 3 and 5 into the atmosphere. In order to provide a remedy in this case a slide gate 6 is associated with the connecting member 4 and the slide gate may be moved out of the open position into a closed position shutting off the passage opening 5.

The passage opening 5 is located on the main body 7 of the connecting member 4 and the main body 7 is bonded to the wall of the filter bag 2. In this respect, the main body 7 consists of board or cardboard material and has a sheet-like structure made up of a plurality of plies. The slide gate 6 is placed between two plies 8 and 9 of the main body and has its handle 10 projecting laterally past the main body 7.

During use of the filter bag the slide gate 6 is in its open position, in which it does not prevent passage of the dust into the filter bag.

The slide gate 6, when it is in the open position and extends over the main body part of the passage opening 5, may in this respect have a passage 11 corresponding to the passage opening 5 and aligned with the passage opening 5 in the open position. When it is later transferred into the shut position, something that is done by hand using its handle 10, the slide gate 6 is moved in a plane which extends perpendicularly to the axes of the holes 5 and 11 in the connecting member and then moves so that a non-perforated part is over the passage opening 5 to thereby close the opening 5. During motion of the slide gate, the latter is guided between the two plies 8 and 9 in the main body 7.

The description also applies in all respects for the working embodiment in accordance with FIGS. 11 through 15 so that like parts are denoted by like reference characters but with the addition of the letter "a". To this extent the connecting member in accordance with FIGS. 11 through 15 will not be described in particular detail.

All the working embodiments of the invention have the common feature that the main body is made by folding a single cutout along scored fold lines and after such folding the superposed plies of the main body are bonded together and furthermore the slide gate is at least in part a component of the cutout and is connected with the remainder of the cutout along preset tear lines so that after folding and bonding are completed the slide gate may be torn off when pulled to the side.

When in the present context there are references to the preset fold lines and preset tear lines, this is intended to indicate that here the material of the cutout is partly still integrally connected but that however it may be creased or may be torn apart by lateral tearing. This is possible by scoring or stamping the preset fold or tear lines during the course of manufacture.

In the case of the connecting member illustrated in FIGS. 2 through 10, it is a question of a foldable cutout 12, which may be folded to a dual-ply structure so that the above noted plies 8 and 9 are formed. The cutout 12 has two cutout zones 14 and 15 which are separated by the preset fold line 16 from each other. In this respect the cutout zone 14 constitutes the ply 8 of the main body and the cutout zone 15 constitutes the ply 9 of the main body. The cutout 12 has an elongated configuration with a rectangular outline, the preset fold line 16 extending in the middle part transversely over the cutout so that the two cutout zones 14 and 15 appear essentially bilaterally symmetrical about the preset fold line 16. In each of the two cutout zones 14 and 15, which are on top of each other after folding about the preset fold line 16, there is a part of the passage opening 5' and, respectively, 5", such parts of openings constituting together the passage opening.

Each of the two zones 14 and 15 separated from each other by the preset fold line 16 has on its end which is opposite to the fold line 16, that is to say at the longitudinal end of the cutout 12, a handle part 10' and, respectively, 10", which is connected via lines preset tear lines 17, 18. In the finished connection member 4, the two handle parts 10' and 10" constitute the handle 10 of the slide gate.

In the case of connecting member 4 the slide gate 6 is formed by the handle 10 and a slide gate tape 19 firmly connected with the same, such tape 19 containing the passage opening 11 and being placed between the two plies 8 and 9 of the main body, while the handle 10 is positioned laterally thereof. The slide gate tape 19 consists of flexible material and more particularly of comparatively tear resistant paper or the like, or of a fabric. The manufacture of the connecting member 4 is so performed that prior to folding the cutout, the end 19' of the slide gate tape 19 is bonded to one of the two handle parts, that is to say in the illustrated working embodiment the handle part 10', and its other end 19" on the other side of the preset fold line 16, on the top side of the cutout which in the folded condition is on the inside. It will be clear that in this case the part 5" of the passage opening in the cutout zone 15 is free of slide gate tape 19, that is to say the bonding of the end 19" of the tape takes place between this part 5" of the opening and the preset fold line 16. Once the slide gate tape 19 has been attached in this manner, the cutout is folded and the two cutout parts 14 and 15 are bonded to each other on the two sides of the slide gate tape, the other handle part 10" being simultaneously bonded to the tape end 19' which is already bonded to the handle part 10'.

Figure 5:
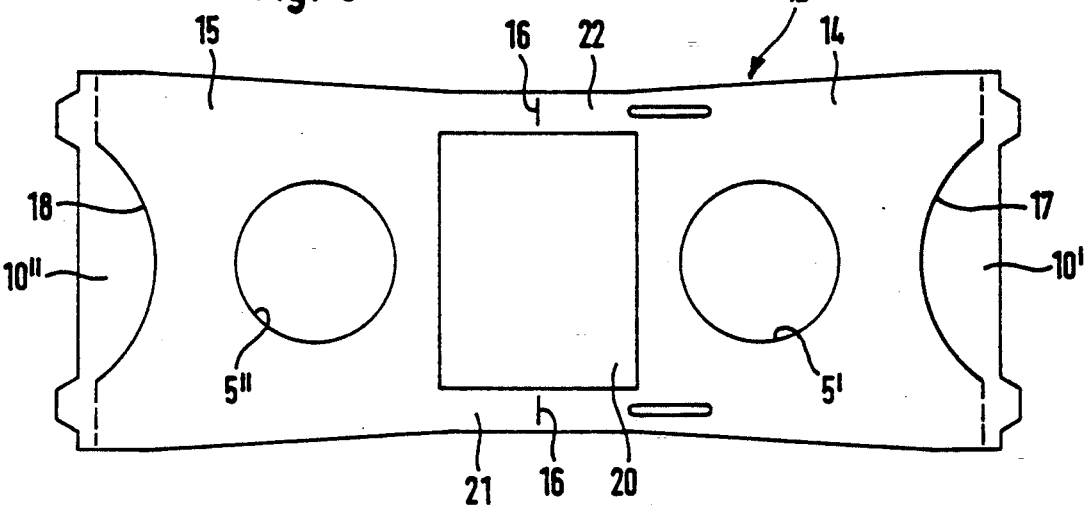
FIG. 5 shows the cutout used for the manufacture of the connecting member in accordance with FIGS. 1 through 4.
Figure 6:
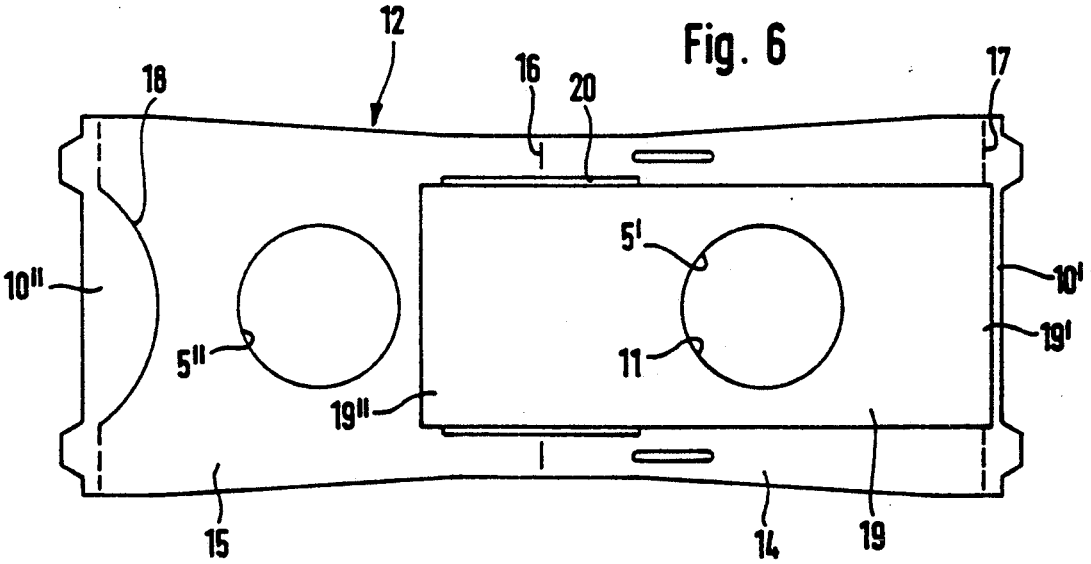
FIG. 6 shows the cutout in accordance with FIG. 5 with the slide gate tape bonded in position.
Figure 7:
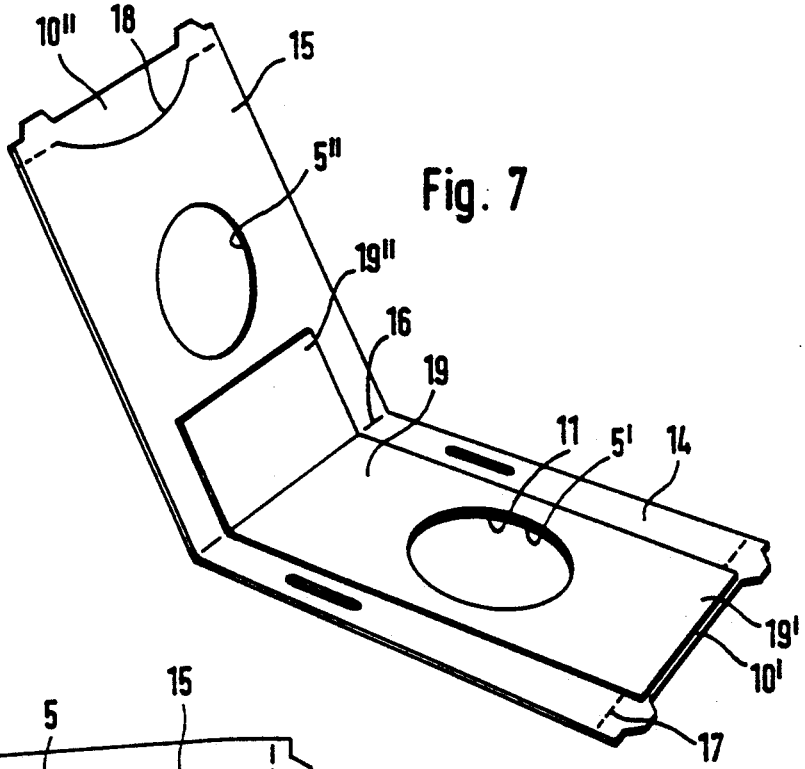
FIG. 7 shows an oblique view of the arrangement in accordance with FIG. 6 during folding to form a two-ply structure.

The first step is thus for the cutout in accordance with FIG. 5 to be cut or stamped out. The slide gate tape 19 is then bonded in accordance with FIG. 6. In this connection it is to be expressly noted that no part of the cutout zone 14—with the possible exception of the handle part 10' arranged on the end thereof—is bonded to the tape 19. On the other side of the preset fold line 16 as well as far as its end 19" the tape 19 remains free of bonding to the cutout zone 15. When the slide gate tape 19 has been secured in this manner, the two cutout zones 14 and 15 are folded onto each other in the manner illustrated in FIG. 7, adhesive having been brushed onto at least one of the two cutout zones along its longitudinal edges before such folding so that the two cutout zones are bonded together laterally adjacent to slide gate tape 19 and on the handle 10' over the tape end 19'. The result is then the arrangement illustrated in FIG. 8, which may be used directly as a connecting member.

Figure 9:
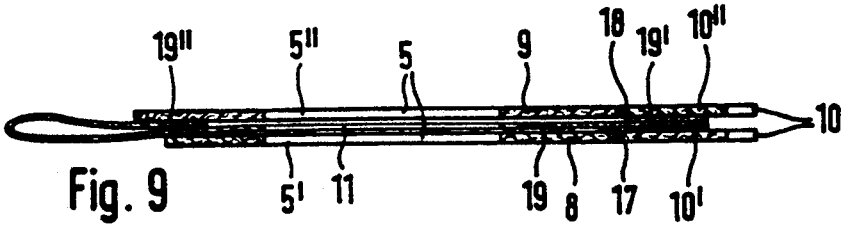
FIG. 9 shows the complete connecting member in a section running in the longitudinal direction thereof and on the section line IX—IX of FIG. 2.
Figure 10:
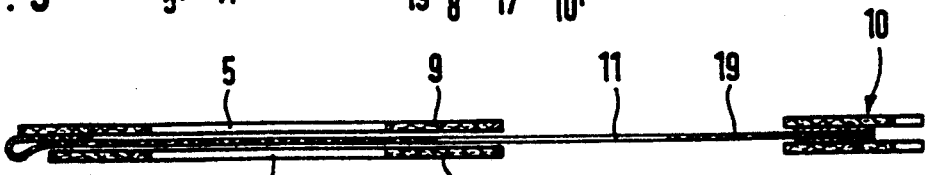
FIG. 10 shows the same connecting member in a cross section corresponding to FIG. 9 but with the slide gate pulled out into its shut position.
Figure 11:
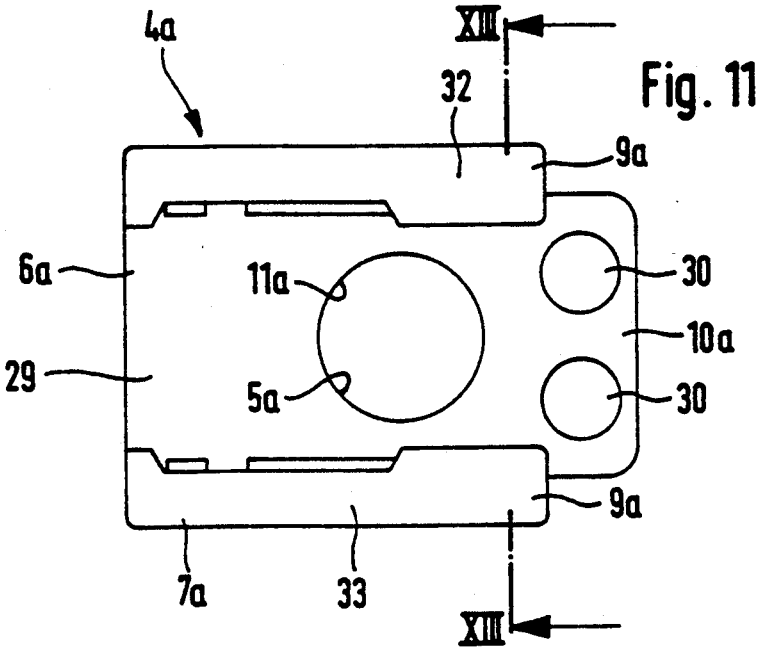
FIG. 11 shows a second working embodiment of the connecting member in a view corresponding to the view of FIG. 2.

In FIGS. 9 and 10 the two plies 8 and 9 the distance between the two plies 8 and 9 has been exaggerated as otherwise the slide gate tape would not have been illustrated clearly enough.

As above noted, the cutout 12 has the two identical handle parts 10' and 10". In principle it would also be possible to provide only one of these handle parts, that is to say the parts on which the gate slide tape 19 is stuck prior to the folding of the cutout.

Adjacent to the preset bend line 16 the cutout 12 has a window 20 whose breadth (that is to say the dimension measured along the preset bend line) is equal at least to the gate slide tape 19, such window being in the form of a rectangular cut opening, the two cutout zones 14 and 15 being connected on the two sides of the window 20 by means of a respective connection rib 21 and 22 with each other. The preset bend line 16 is only to be found on these connection ribs 21 and 22. It will be clear that the end 10" of the slide gate tape is bonded between the part 19" of the passage opening and the adjacent end of the window of the cutout zone 15. In the condition prior to folding the slide gate tape 19 extends in the longitudinal direction of the cutout past the window 20. In the folded condition (FIG. 8) the window 20 leads to a U-like end of the main body, the slide gate tape 19 being visible from the outside between the two connection ribs 21 and 22. The two said connection ribs 21 and 22 may be furthermore cut off after manufacture of the arrangement in accordance with FIG. 8 so that there would be the connecting member 4 as illustrated in FIGS. 1 through 4. But it would be possible to leave the connection ribs 21 and 22 as they are. In principle it would also be possible not to provide the window 20 so that the entire gate slide tape would be covered over. The appearance of the connecting member in this part is more particularly dependent on the type of filter bag for which the connecting member is intended.

On joining the cutout 12 and the bonded slide gate tape 19 together by folding the section, which extends from the preset fold line 16 and faces the zone 16 of the cutout 15, of the slide gate tape, which has its end 19" stuck to the zone 15 of the cutout, extends past the section of the tape running along the zone 14 of the cutout so that the slide gate tape has two plies at this position. This dual-ply part is opposite to the handle 10.

Figure 4:
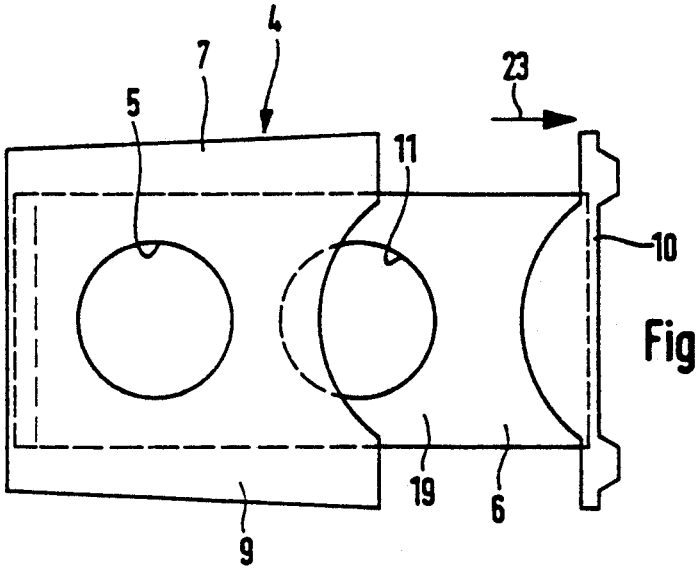
FIG. 4 shows the same connecting member with the slide gate in the shut position.
Figure 8:
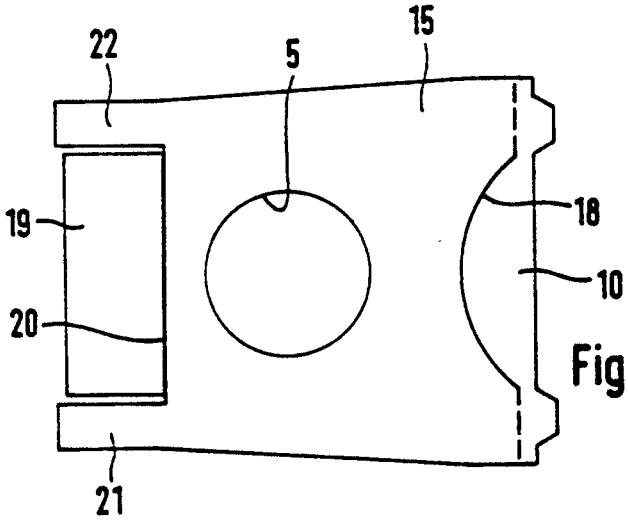
FIG. 8 shows the arrangement in accordance with FIGS. 6 and 7 after the operations of folding and bonding.

After completing the arrangement in accordance with FIG. 8 and, respectively, of the connecting member 4 in accordance with FIGS. 1 through 4 it is possible to grip the handle 10 and exert a pulling force to the side in the direction of the arrow 23 to tear off the two handle parts 10' and 10" from the cutout zones 14 and 15, which form the plies of the main body 8 and 9, along the preset tear line 17 and 18 so that the handle 10 is separated from the main body 7. When the handle 10 is so pulled the slide gate tape 19 adhering to it is entrained as well so that the passage opening 11 is removed from the passage opening 5 and the slide gate tape is pulled over the passage opening and closes it (FIG. 4). This movement is made possible by having two layers of the tape at the end of the connecting member opposite to the handle. The dimension as measured in the longitudinal direction of the tape of the two-ply tape zone becomes shorter on transferring the tape into the shut position, this being clear from a comparison between FIGS. 9 and 10.

The connecting member 4 is secured to the filter bag 1 even before the handle 10 has been torn off. It is only when the filter bag is filled and has been removed from the vacuum cleaner equipment that the handle 10 is detached and the slide gate tape is pulled into the shut position.

As noted earlier, when attaching the filter bag 1 in the vacuum cleaner it is possible for the connecting member 4 to be slipped over a connection spout of the cleaner, which then extends into the passage opening 5 or, respectively, extends out through it. In this case it is possible for the connection spout to protrude towards the interior of the bag somewhat past the connecting member. This at the most only slightly hinders the transfer of the slide gate tape 19 into the shut position, since the slide gate tape consists of flexible material so that it may be pulled over the opening of the spout.

The following account is directed to the other convenient working embodiment in accordance with the invention as illustrated in FIGS. 11 through 15.

In the illustrated working embodiment the connecting member 4a is made starting with a single-piece cutout 12a for folding (FIG. 14), which may be folded into a three-ply structure. In this respect the middle cutout zone 24 constituting the middle ply and from which the cutout zones, which lead to the two other plies 8a and 9a—that is to say the outer plies—are bent towards opposite sides, as seen as a sheet or area has a configuration like a bar between two mutually opposite guide parts 25 and 26 and there is a slide gate part 29 connected with the latter via preset tear lines 27 and 28. As regards closing of the passage opening 5a of the completed connecting member 4a the gate slide gate part 29 is made corresponding to the slide gate tape 19 of the working embodiment described above. In the case of FIGS. 11 through 15 it is however a question of a slide gate 6a which is made integral and even includes the handle 10a and which is a component of the initial cutout 12a of cardboard or thick stiff paper.

In the case of completed connecting member 4a the slide gate 6a together with the guide parts 25 and 26 running adjacent to it form the middle ply between the two outer plies 8a and 9a. In this respect in the folded condition the slide gate part 29 is straddled at least at its longitudinal edges adjacent to the guide parts 25 and 26, that is to say at least in the vicinity of the preset tear lines 27 and 28, by the two outer plies 8a and 9a. If the two outer plies 8a and 9a are bonded to the guide parts 25 and 26 the result is the three-ply main body 7a. Such bonding is performed so as to leave the gate slide part 29 free. Therefore after such folding and bonding it is possible to tear free the gate slide part 29 by pulling the handle 10a to the side clear of the guide parts 25 and 26, whereafter the slide gate part forms the slide gate 6a, which guided on the outer plies 8a and 9a and the 25 and 26 may be pushed into the closed position in accordance with FIG. 12, in which its passage opening 11a is no longer in alignment with the passage opening 5a of the main body and is in fact positioned clear of it so that the passage opening 5a is covered by the slide gate.

The laterally projecting handle part 10a of the slide gate may be provided as illustrated with gripper openings 30 for the fingers in order to facilitate grasping with the hand.

Apart from the handle 10a, the cutout zone 24, which constitutes the middle ply, has a rectangular configuration. At the edges of this rectangular cutout zone 24 the cutout zones constituting the outer plies 8a and 9a are set so that it is possible to bend the cutout zone 31 constituting the one outer ply 8a, to one side and to bend the cutout zone 32 constituting the other outer ply 9a to the opposite side. One of the two outer ply cutout zones, in the illustrated working embodiment, the cutout zone 31, is set on the cutout zone 24 forming the edge, which is opposite to the handle 10a, of the cutout zone 24 constituting the middle ply, these two cutout zones 24 and 31 being separated from each other by the preset fold line 34. The cutout 12a is cut right through along the preset fold line 34 past the breadth of the slide gate so that the slide gate 29 is not linked to the cutout zone 31, this facilitating the tearing off of the slide gate. In the case of a convenient working embodiment the cutout zone 31 is only connected with the guide parts 25 and 26 by residual bridges of material.

The said cutout zone 31 has the same external dimensions as the cutout zone 24, which constitute the center ply, without the handle 10a so that it completely covers the latter in the folded condition. The passage opening 5a is formed on this cutout zone 31. The passage opening 11a is symmetrical about the preset fold line 34 with respect to passage opening 5a so that after creasing and superposition of the two cutout zone 24 and 31 the passage opening 5a and the passage opening 11a are in alignment with each other.

The outer ply constituted by the cutout zone 31 will form the lower surface of the finished connecting member 4a, such surface serving to bond the connecting member to the filter bag 1.

The cutout zone 32 and 33 constituting the other outer ply 9a in a convenient working embodiment is set on the cutout zone 24 constituting the middle ply, at the edge and so as to be parallel to the direction of sliding of the slide gate 6a. In this respect in accordance with a preferred feature of the invention this cutout zone constituting the outer ply is divided into two parts 32 and 33 each set on one of the two guides parts 25 and 26, and having a strip-like form. The part 32 is thus adjacent to the longitudinal edge of the opposite guide part 26, and between them there is a respective preset bend line for bending 35 and, respectively, 36 so that the strip-like parts 32 and 33 may be bent over. The said parts 32 and 33 are broader than the guide parts 25 and 26 so that in the completed connecting member 4a they overlap the slide gate 6a laterally somewhat in order to keep it in place. It will be clear that the parts 32 and 33 do not have to be broader than the guide parts 25 and 26 along their entire lengths.

During the manufacture of the connecting member 4a the starting point is therefore the cutout 12a, whereafter the cutout zone 31 is bent over to one side and the two parts 32 and 33 are bent over adjacent to other side of the cutout zone 24. Previously one will have applied adhesive to the cutout by brushing on the desired parts so that the guide parts 25 and 26 will on the one hand only be bonded to the cutout zone 31 and on the other hand with the two parts 32 and 33 and the slide gate 29 will remain free. After ripping off the slide gate 6a the latter is guided at the edge along the guide parts 25 and 26.

Figure 12:
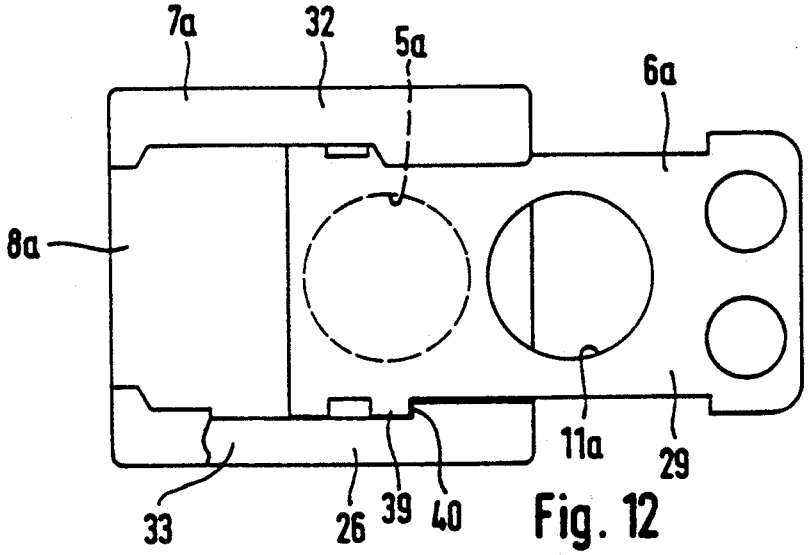
FIG. 12 shows the connecting member in accordance with FIG. 11 with the slide gate pulled into the shut position.
Figure 13:
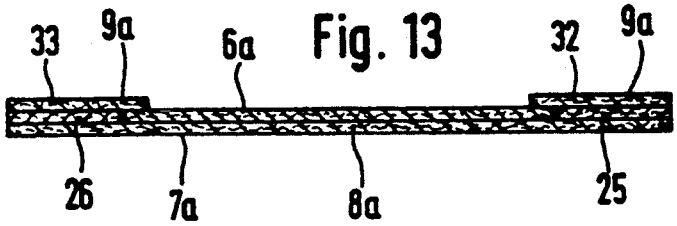
FIG. 13 shows the connecting member in accordance with FIGS. 11 and 12 in a cross section at a right angle to its longitudinal direction on the section line XIII—XIII of FIG. 11.

In order to ensure that the detached slide gate 6a is not accidentally completely pulled out of the main body 7a, at least one longitudinal edge of the slide gate 29 and, respectively, of the gate slide 6a and the facing guide part 25 and 26 has a stepped form in such a manner that the detached slide gate 6a forms abutments precluding complete withdrawal. This stepped design is produced by a suitable form of the preset tear line 27 and 28 together with a slot 37 and, respectively, 38 between the guide part 25 and, respectively, and the slide gate part 29. As shown in FIG. 12, an outer ply of the connecting member 4a has been partly cut away at 33 so that the lateral abutment projection 39 on the slide gate is visible. On pulling outwards it comes into engagement with the guide part 26. In the illustrated working embodiment the arrangement is the same on both sides of the slide gate.

The embodiments of the invention in which an exclusive property or privilege is claimed are defined as follows:

1. A method for the manufacture of connecting members for dust collecting filter bags for vacuum cleaning equipment, said filter bags having a dust inlet opening comprising the steps of:

forming a flat blank into a cutout having at least one handle section coplanar with said cutout and a means defining a first passageway extending through said cutout;

forming a slide gate with a second passageway extending therethrough;

scoring said cutout at plural locations to define plural bend lines;

partially precutting said cutout along precut lines to provide a separable connection between said cutout and at least said handle section and an ability of said handle section being separated at said separable connection from said cutout whenever a sufficient separating force is applied to said handle section;

folding said cutout about said fold lines to form superposed plies;

positioning said slide gate between said plies so that said first and second passageways are initially coaxially aligned;

rendering said handle section capable of effecting a movement of said slide gate therewith at the time said sufficient separating force is applied to said handle section;

securing said superposed plies together while maintaining the ability of said slide gate to move with said handle section, said movement causing said second passageway to move out of coaxial alignment with said first passageway to effect a closing of said first passageway; and aligning at least said first passageway with said dust inlet opening into said filter bag and securing said connecting member to said filter bag while maintaining said alignment of said first passageway with said dust inlet opening.

2. The method as claimed in claim 1, wherein said step of forming a means defining a first passageway includes the step of forming a single first passageway in said cutout on an opposite side of a said bend line from said second passageway means, and wherein said rendering step includes an integral forming of said handle section and said slide gate on said cutout, and wherein said cutout is adapted to be folded to form a three-ply structure, said slide gate constituting a middle ply oriented between two laterally opposite guide parts, said slide gate being connected via said partially precut lines on said cutout to said guide parts, said slide gate in the folded condition of said cutout at least at longitudinal edge parts thereof adjacent to said guide parts, being sandwiched between two outer plies, said outer plies being bonded to said guide parts leaving said slide gate free so that said slide gate may be detached from said guide parts and then moved by a force applied to said handle section into a position closing said first passageway.

3. The method as claimed in claim 2, wherein one of the two outer plies is an extension of the middle ply that is folded to an outer ply position.

4. The method as claimed in claim 2, wherein one of the outer plies is defined by opposite lateral margin portions of said middle ply, said opposite lateral margin portions each being connected to a respective guide part by one of said bend lines and folded about said bend lines and bonded to said guide part to form a guide track for guiding said slide gate movement.

5. The method as claimed in claim 4, wherein at least one longitudinal edge of said slide gate and the edge of the adjacent guide part are formed to have a stepped configuration so as to define mutually engageable abutments for preventing a complete withdrawal of said slide gate from said guide track.

6. The method as claimed in claim 1, wherein said cutout is adapted to be folded into a two-ply structure, each ply being separated from each other by a said bend line with at least one ply having a handle part of said handle section at an end remote from said bend line, said handle part being connected with the rest of said cutout by said partially precut lines, wherein said step of forming of a means defining a first passageway includes the step of forming a pair of separate first passageways in said cutout on opposite sides of a said bend line which, when folded into said two-ply structure, become axially aligned, wherein said rendering step includes, prior to folding said cutout, a flexible slide gate tape being bonded at one end to said handle part and at the other end to a top side of said cutout, said slide gate tape, in the folded condition of said cutout, being oriented between said two plies so that said handle part may be separated from said cutout by pulling on said handle part to cause said second passageway in said slide gate tape to move out of alignment with said aligned first passageways.

7. The method as claimed in claim 6, wherein a corresponding handle part is provided on the other ply and is simultaneously bonded to the end of said slide gate tape when the two plies are bonded together.

8. The method as claimed in claim 6, wherein adjacent to said bend line said cutout has means defining a window corresponding in its width at least to the width of said slide gate tape and the two lateral sides of said opening on opposite sides of the bend line are connected together to define connection ribs.

9. The method as claimed in claim 8, wherein said connection ribs are removed from said connecting member after bonding the plies with each other.

* * * * *

UNITED STATES PATENT AND TRADEMARK OFFICE

CERTIFICATE OF CORRECTION

PATENT NO. : 5 158 635

DATED : October 27, 1992

INVENTOR(S) : Erich SCHMIERER et al

It is certified that error appears in the above-identified patent and that said Letters Patent is hereby corrected as shown below:

Column 9, line 62; after "two" insert ---mutually---.

Signed and Sealed this

First Day of June, 1993

*Attest:*

Michael K. Kirk

MICHAEL K. KIRK

*Attesting Officer*

*Acting Commissioner of Patents and Trademarks*